US011553780B2

(12) United States Patent
Zainitzer et al.

(10) Patent No.: US 11,553,780 B2
(45) Date of Patent: Jan. 17, 2023

(54) BRUSH HEAD MANUFACTURING METHOD

(71) Applicant: KONINKLIJKE PHILIPS N.V., Eindhoven (NL)

(72) Inventors: Christian Zainitzer, Klagenfurt (AT); Florian Kopeinig, Klagenfurt (AT); Michael Meidl, Seeboden (AT); Thomas Johannes Gaertner, Villach (AT); Martin Varch, St. Margareten (AT)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 211 days.

(21) Appl. No.: 16/628,198

(22) PCT Filed: Jun. 20, 2018

(86) PCT No.: PCT/EP2018/066340

§ 371 (c)(1),
(2) Date: Jan. 2, 2020

(87) PCT Pub. No.: WO2019/011599

PCT Pub. Date: Jan. 17, 2019

(65) Prior Publication Data

US 2021/0145158 A1 May 20, 2021

Related U.S. Application Data

(60) Provisional application No. 62/576,142, filed on Oct. 24, 2017, provisional application No. 62/531,400, filed on Jul. 12, 2017.

(51) Int. Cl.
*A46B 3/06* (2006.01)
*A46D 3/04* (2006.01)
(Continued)

(52) U.S. Cl.
CPC ..... *A46B 3/06* (2013.01); *A46B 3/04* (2013.01); *A46D 3/045* (2013.01); *A46B 9/04* (2013.01); *A46B 2200/1066* (2013.01)

(58) Field of Classification Search
CPC ..... A46B 3/06; A46D 3/045; A46D 3/04
(Continued)

(56) References Cited

U.S. PATENT DOCUMENTS 4,637,660 A 1/1987 Weihrauch
5,970,564 A 10/1999 Inns
(Continued)

FOREIGN PATENT DOCUMENTS

DE 10221786 A1 11/2003
DE 20301634 U1 6/2004
(Continued)

OTHER PUBLICATIONS

Computer generated English translation of WO 2004/080238 A1, Clos, Sep. 2004. (Year: 2004).*
(Continued)

*Primary Examiner* — Laura C Guidotti

(57) ABSTRACT

A brush head (10) and a method for manufacturing a welded tuft assembly (20) for a brush head (10). The method includes inserting a bristle tuft (21) into an opening (51) in a retention element (52). A proximal end of the bristle tuft (23) and a proximal side (53) of the retention element are laser welded to at least partially melt the bristle tuft and at least a portion of the proximal side of the retention element together to create a merged proximal end head portion (26) that holds the welded tuft assembly together.

16 Claims, 6 Drawing Sheets

(51) Int. Cl.
*A46B 9/04* (2006.01)
*A46B 3/04* (2006.01)

(58) Field of Classification Search
USPC ..... 300/21
See application file for complete search history.

(56) References Cited

U.S. PATENT DOCUMENTS

| | | | | |
|---|---|---|---|---|
| 6,045,649 | A | 4/2000 | Weihrauch | |
| 7,281,768 | B2 * | 10/2007 | Sato | A46B 3/02 300/2 |
| 8,069,524 | B2 | 12/2011 | Kraemer | |
| 2001/0024060 | A1 | 9/2001 | Boucherie | |
| 2009/0218771 | A1 | 9/2009 | Sparks | |
| 2010/0192319 | A1 | 8/2010 | Russell | |
| 2017/0105824 | A1 * | 4/2017 | Dengler | A46B 3/04 |

FOREIGN PATENT DOCUMENTS

| | | | | |
|---|---|---|---|---|
| DE | 10310902 | A1 | 9/2004 | |
| DE | 102009007460 | A1 | 8/2010 | |
| EP | 1603429 | B1 | 8/2007 | |
| EP | 2807946 | A1 | 12/2014 | |
| WO | WO 2004/080238 | A1 * | 9/2004 | A46D 3/04 |
| WO | 2016181291 | A1 | 11/2016 | |

OTHER PUBLICATIONS

International Search Report and Written Opinion, International Application No. PCT/EP2018/066340, dated Dec. 17, 2018.

* cited by examiner

BRUSH HEAD MANUFACTURING METHOD

This application is the U.S. National Phase application under 35 U.S.C. § 371 of International Application No. PCT/EP2018/066340, filed on 20 Jun. 2018, which claims the benefit of U.S. Provisional Application No. 62/531,400, filed 12 Jul. 2017 and U.S. Provisional Application No. 62/576,142, filed 24 Oct. 2017. These applications are hereby incorporated by reference herein.

FIELD OF THE INVENTION

The present disclosure is directed generally to methods for manufacturing a brush head assembly having welded tuft assemblies formed by laser welded bristle tufts.

BACKGROUND

The brush heads of both manual and power toothbrushes comprise bristles which are used to clean the teeth, tongue, and cheeks. In some toothbrushes, the bristles are stapled or anchored into the neck portion of the brush head. In other toothbrushes, the bristles are secured in the head without staples, in methods commonly known as "anchor free tufting (AFT)". In some toothbrushes made using AFT, the bristles are organized into bristle tufts positioned within openings of a carrier plate, support element, or other holding structure. During manufacture, the bristle tufts are inserted into the hollow interior of the retention element, and the proximal portion of the inserted bristles are melted together using a hot knife or heating plate to form a melted end to secure the bristles in the retention ring. These structures and manufacturing steps are implemented with the purpose of holding the bristles in the brush head during its use.

Often, however, in practice, the meltind may not be performed evenly, uniformly or consistently. In such cases, individual bristles or the entire bristle tufts are not secured firmly within the retention elements. Consequently, under the dynamic conditions of motion of the power toothbrush operation, the bristles or bristle tufts may be oriented, positioned or moved so that brushing performance degrades; or the bristles or bristle tufts may separate in whole or in part from the brush head.

Accordingly, there is a need in the art for methods and apparatus for more effectively and efficiently heating the bristle tuft ends to achieve a more uniform melting and improved bonding of the bristles and the retention elements.

SUMMARY OF THE INVENTION

The present disclosure is directed to inventive methods for manufacturing a brush head with bristle tufts secured in retention elements. Various embodiments and implementations herein are directed to manufacturing methods using a more efficient and effective method of heating using laser welding, in the step in which bristle tufts are melted together to form a head at one end thereof, or in which the bristle tufts are melted and merged with or bonded to retention elements to secure the bristle tufts and retention elements together. The resulting components, along with a brush head neck, are then encompassed, at least in part, within a matrix, such as an elastomeric material, resulting in a completed brush head. Using the various embodiments and implementations herein, cost-effective and efficient production of brush heads is substantially improved.

For example, in some embodiments, the manufacturing method includes inserting a tuft of bristles into a retention element and then using the beam of a laser to melt and merge the proximal end of the bristle tufts to form a proximal end head portion that resists disengagement with the retention element. The laser may also be used to melt and merge the proximal end of the bristle tuft to at least a portion of the proximal side of the retention element. The brush heads disclosed and described herein can be used with any manual or power toothbrush device.

Generally, in one aspect, a method for manufacturing a welded tuft assembly for a brush head is provided. The method includes inserting a bristle tuft into an opening in a retention element; and laser welding a proximal end of the bristle tuft and a proximal side of the retention element to at least partially melt the bristle tuft and at least a portion of the proximal side of the retention element together to create a merged proximal end head portion that holds the welded tuft assembly together.

In one embodiment, the inserting comprising inserting each of a plurality of bristle tufts into one of a plurality of the retention elements. In one embodiment, the plurality of retention elements are included by a single tuft carrier. In one embodiment, the single tuft carrier comprises a plurality of webbing links interconnecting the plurality of retention elements together. In one embodiment, the webbing links arrange the retention elements and bristle tufts in a general pattern that defines a final layout for the brush head when fully assembled. In one embodiment, the single tuft carrier comprises a carrier plate that includes the plurality of retention elements.

In one embodiment, each of the plurality of retention elements and the plurality of bristle tufts are made of the same material or a similar material having a same or similar melting temperature. In one embodiment, the plurality of retention elements and the plurality of bristle tufts are made of materials having a different melting temperature.

In one embodiment, the method further includes adjusting a length, shape, or contouring of the bristle tuft at the proximal end, a free end opposite the proximal end, or both, before the laser welding. In one embodiment, the method further includes positioning one or more of the welded tuft assemblies with respect to a neck of the brush head and overmolding a matrix to connect the neck and the welded tuft assembly together.

Generally, in another aspect, a brush head assembly is provided. The brush head assembly includes a neck having a platen; a plurality of bristle tufts, each of which comprises a plurality of bristle strands, and having a free end and a proximal end; a tuft carrier having a plurality of retention elements corresponding to the plurality of bristle tufts, each retention element having an opening configured to receive a proximal end of a corresponding one of the bristle tufts; a plurality of merged proximal end head portions formed from the proximal end of each bristle tuft and at least a portion of a proximal side of each corresponding retention element melted together and uniformly sealed by laser welding; and a matrix bonded to and at least partially encapsulating the platen, the plurality of retention elements of the tuft carrier, and the merged proximal end head portions.

In one embodiment, the plurality of retention elements are interconnected by a plurality of webbing links. In one embodiment, wherein the plurality of retention elements are included by a single carrier plate. In one embodiment, wherein the retention elements and the bristle tufts are made of the same material or a similar material having a same or similar melting temperature. In one embodiment, the retention elements and the bristle tufts are made of different materials are made of the materials having a different melting temperature.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of a method for manufacturing a brush head assembly which provides a more even and consistent method of melting the proximal ends of the bristle tufts, or the proximal end of the bristle tufts and proximal side of the retention elements together using a laser to provide the melting. More specifically, applicants have recognized and appreciated that it would be beneficial to provide a method of manufacturing a brush head that has an improved method of joining bristles and retention elements, rather than just inserting the bristles in retention elements, for increased retention of the bristles therein. This is accomplished by using a laser to merge and bond the proximal portion of the bristle tufts, or at least a portion of the proximal side of the retention element and the proximal portion of the bristle tufts to form a proximal end head portion or a merged proximal end head portion. By forming retention elements and bristle tufts out of the same or similar material that will merge or bond together when laser melted, it provides the ability to efficiently manufacture brush heads.

In view of the foregoing, various embodiments and implementations are directed to a method in which a bristle tuft is inserted in a retention element and the proximal end of the bristle tuft or proximal end of the bristle tuft and at least a portion of the proximal side of the retention element are heated using laser welding for uniform and consistent melting of the retention element and bristle proximal ends for bonding or merging of the bristles in, with or to the retention elements. The tuft assemblies formed from merging the bristle tuft and retaining element together may then be used in forming a brush head, such as by encompassing them, at least in part, by an elastomeric matrix to form the brush head.

Figure 1A:
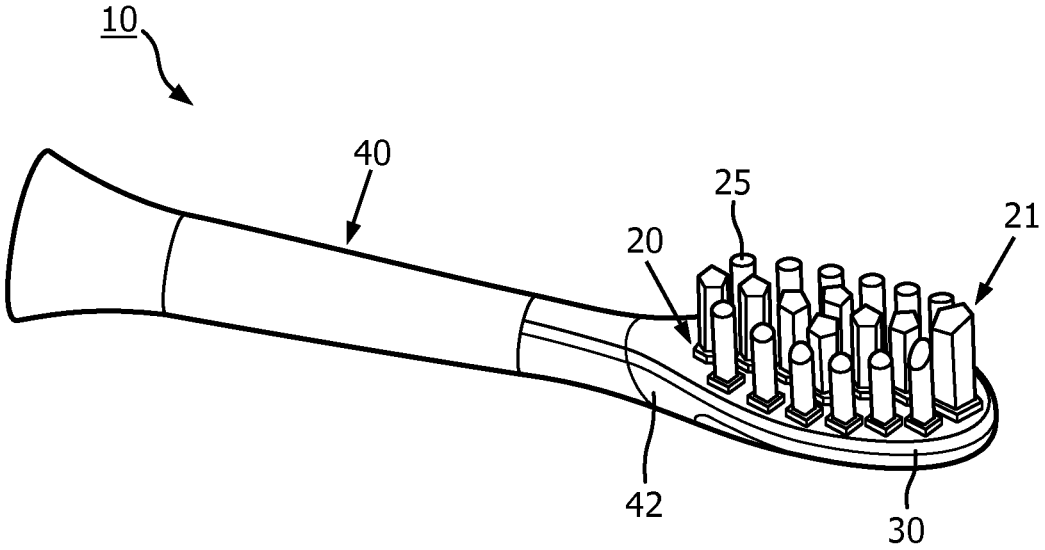
FIG. 1A is a perspective schematic representation of a brush head assembly in accordance with an embodiment.
Figure 1B:
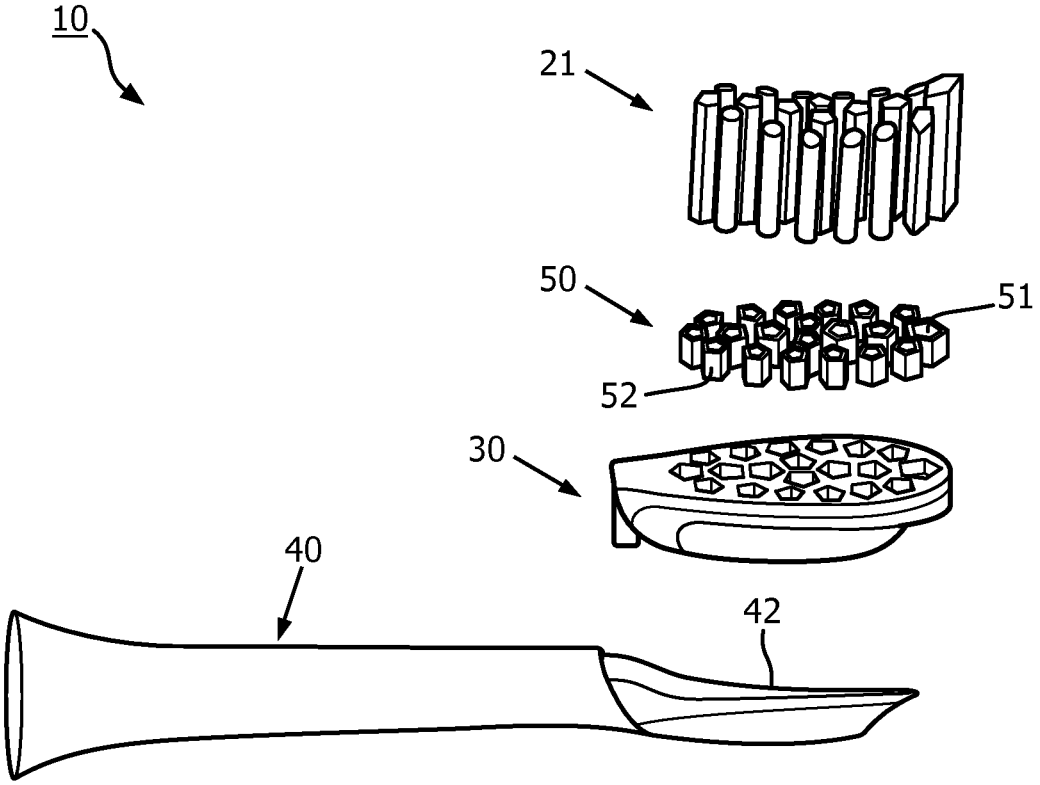
FIG. 1B is a perspective exploded view of the brush head assembly of FIG. 1A.

Referring to FIG. 1A, in one embodiment, a schematic representation of a brush head assembly 10 is provided. The brush head 10 includes a plurality of welded tuft assemblies 20 disposed in a matrix 30 at the distal end of a neck 40. That is, a distal portion 42 of the neck 40, which may be referred to as a platen, may be at least partially enclosed in and/or connected to the matrix 30. The matrix 30 may be integrally formed with the neck 40 in one embodiment, or in another arrangement there may be an overmolded matrix, such as an elastomeric material. The neck 40 can be coupled to, or form a part of, any manual or powered toothbrush shaft. For example, the neck 40 may be configured to be removably coupled to an actuator or drive shaft (not shown) of a powered oral care device (e.g., electric toothbrush) now known or to be developed.

Figure 2A:
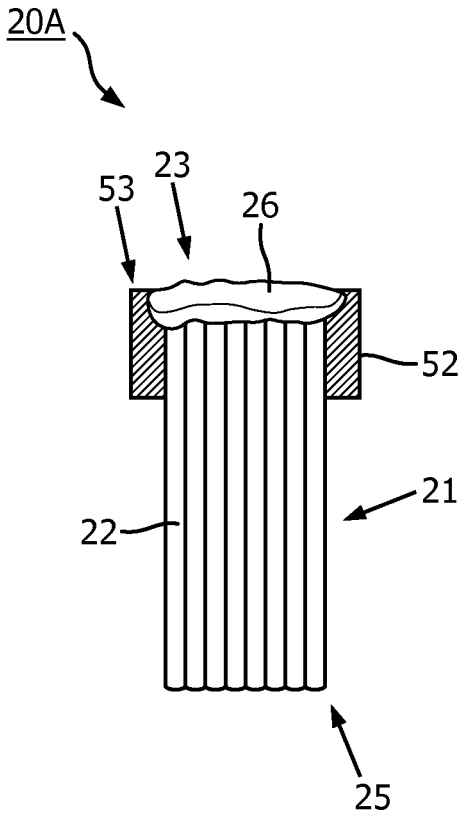
FIGS. 2A and 2B are cross-sectional side views of schematic representations of welded tuft assemblies according to two embodiments disclosed herein.
Figure 2B:
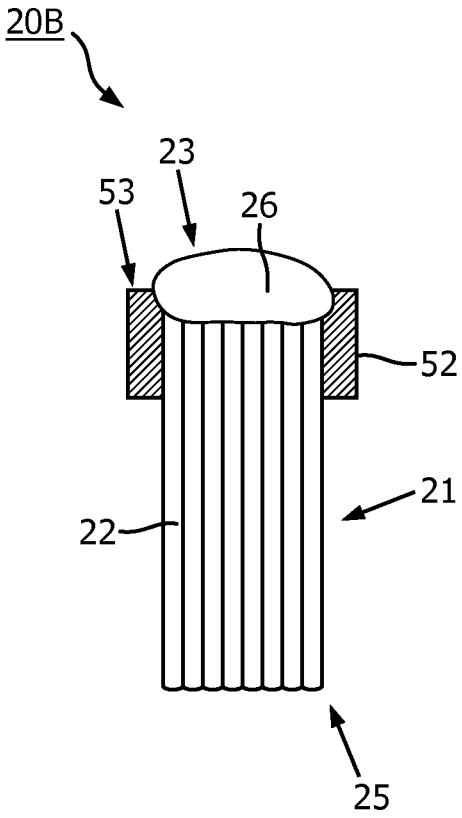

Two examples for the welded tuft assemblies 20 are illustrated in FIGS. 2A and 2B, designated as welded tuft assemblies 20A and 20B, respectively. It is to be appreciated that the reference numeral '20' is intended to generally refer to any of the welded tuft assemblies disclosed herein, while the assemblies 20A and 20B are used herein to facilitate discussion with respect to particular embodiments. It is also to be appreciated that many components of the welded tuft assemblies 20 are shared throughout embodiments, and thus referred to with the same reference numerals.

Referring to FIGS. 1A-2B, the welded tuft assemblies 20 each include a bristle tuft 21, with each bristle tuft 21 comprising a plurality of bristle strands 22. Each bristle tuft 21 has a proximal end 23 and a free end 25. The proximal end 23 of each bristle tuft 21 is retained within an opening 51 of a retention element 52 of the tuft carrier 50, while the free end 25 is located opposite to the proximal end 23 and forms the brushing surface of the brush head 10 when assembled. The bristle tufts 21 can be formed to a shape and diameter to match the size and shape of the retention element openings 51 in the tuft carrier 50.

The retention elements 52 and the openings 51 therethrough can be of the same size, shape and arrangement, such as round, triangular, square, pentagonal, hexagonal, heptagonal, octagonal, nonagonal, decagonal or other shape, or can vary from one another (for example, the retention element 52 may have a first shape defining its outer periphery, while the opening 51 of that retention element 52 has a second shape defining the shape of the bristle tuft 21 inserted therethrough).

Figure 2C:
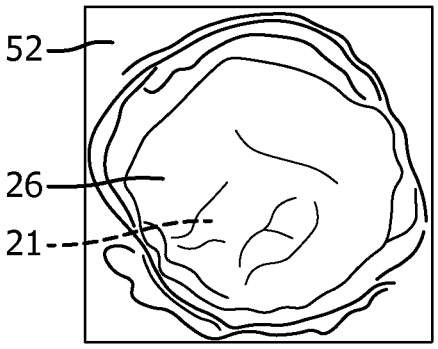
FIG. 2C is a top view of a merged proximal end head portion of a welded tuft assembly after laser welding.

Once the bristle tuft 21 is inserted in the opening 51 of the retention element 52, the proximal end 23 of the bristle tufts 21, or in a preferred arrangement, the proximal end 23 of the bristle tufts 21 and at least a portion of a proximal side 53 of the retention element 52 are joined together using laser welding to form a merged proximal end head portion 26. That is, the merged proximal end head portion 26 may be formed from fused material from the bristles 22 alone, or the bristles 22 together with a portion of the retention element 52 adjacent to the bristles 22, or a combination of both elements. Advantageously, the laser welding process, as described herein, can effectively melt and bond the bristle tufts 21 and retention elements 52 together to form the merged proximal end head portion 26 as a seal that completely seals across the opening 51 at the proximal end 23 of the welded tuft assemblies 20. As shown in FIG. 2A, the merged proximal end head portion 26 may be substantially flush with the proximal side 53 of the retention element 52, or as shown in FIG. 2B, the merged proximal end head portion 26 may be formed with a dome or mushroom shape. For laser welding, the laser concentrates the welding energy more precisely, while enabling more exact application of heat, so that the proximal ends 23 of the bristle tufts 21 and the proximal side 53 of retention elements 52 melt to from a substantially uniform merged proximal end head portion 26, e.g., as shown in FIG. 2C that completely seals the opening 51 at the proximal side 53 of the retention element 52.

The tuft carriers 50 can be formed in a variety of ways, such as molding, stamping, etc. Various embodiments for the tuft carriers 50 can be appreciated in FIGS. 3A-3F. Similar to the reference numeral '20' for the welded tuft assemblies 20, the reference numeral '50' as used herein is intended to refer generally to all embodiments of tuft carriers disclosed or envisioned, while alphabetic suffixes (e.g., 'A', 'B', etc.) have been provided to facilitate discussions of particular embodiments shown in the Figures.

Figure 3A:
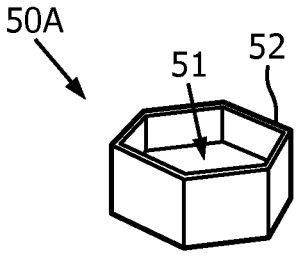
FIGS. 3A-3F are schematic representations of tuft carriers according to different embodiments disclosed herein.
Figure 3B:
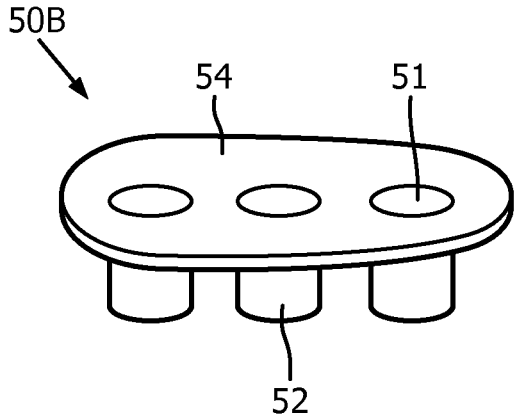
Figure 3C:
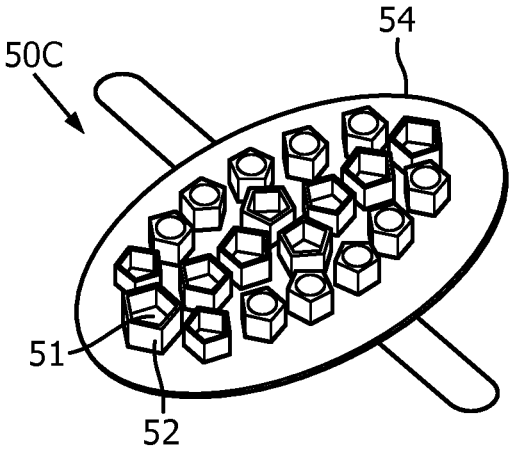
Figure 3D:
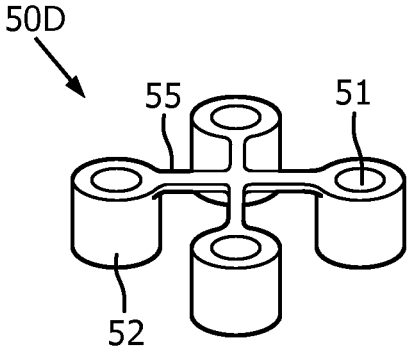
Figure 3E:
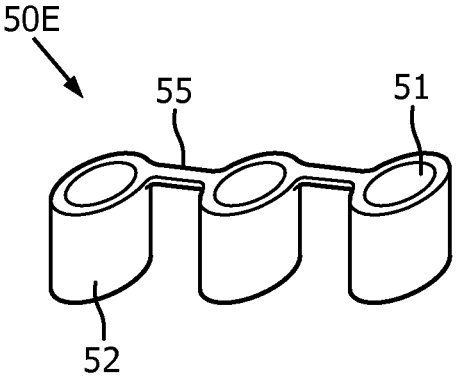
Figure 3F:
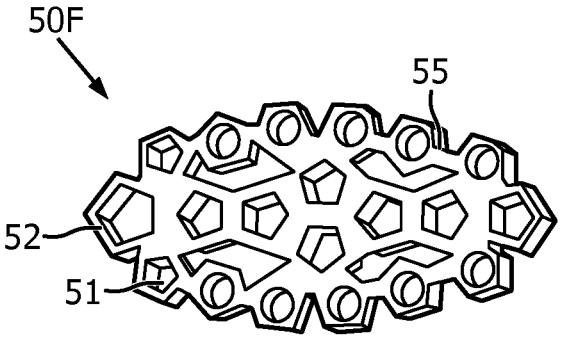

A tuft carrier 50A in FIG. 3A comprises a single one of the retention elements 52, which will hold a single one of the bristle tufts 21 (not shown) in the opening therethrough. FIGS. 3B and 3C respectively show a tuft carrier 50B and a tuft carrier 50C that each comprises a carrier plate 54 having a plurality of the retention elements 52 having an opening 51 therethrough connected together, e.g., arranged in a shape of the final brush head or some portion thereof. In FIGS. 3D-3F, tuft carriers 50D, 50E, and 50F are respectively shown. Each of the tuft carriers 50D-50F comprise a tuft carrier web that has a plurality of individual retention elements 52 having an opening 51 therethrough connected to each other by a series of strands or webbing links 55. Similar to the tuft carriers 50B and 50C, the retention elements 52 and/or the openings 51 of the tuft carriers 50D-50F may be arranged in the desired pattern for the tufts 21 when the brush head is fully assembled, or some portion thereof.

In order to facilitate formation of the merged proximal end head portion 26, the tuft carrier 50 retention elements 52 and the bristle tuft 21 bristles 22 are preferably made from the same material, or materials having a similar composition. Plastics such as Acrylonitrile Butadiene Styrene (ABS), polyamide (PA) or nylon, polypropylene, or variations or combinations of these or other materials can be used. Particularly useful are combinations of materials that have a similar co-efficient of melting to facilitate bonding by melting and cooling at a similar temperature and rate. In one embodiment, the bristles 22 are formed from PA, while the retention elements 52 are formed from a PA/ABS blend. It is to be appreciated that there may be some variability across the weld of the merged proximal end head portion 26, e.g., based on the characteristics of the materials of the bristle strands 22 and/or the retention elements 52, as well as the parameters of the laser beam utilized during welding. In particular, variation may occur if the bristle tuft 21 and the retention elements 52 are made of different materials, which may cause melting/cooling at different temperatures, or other differences due to their different chemical compositions. Additionally, the weld of the merged proximal end head portion may vary across a weld, in areas near the retention element 52 as compared to the area in the center of the opening 51 through the retention element, where there is a greater concentration of bristle material and a lesser concentration of retention element material. However, such variability is acceptable as long as the desired bonding is achieved.

The laser welding will consume at least a portion of the proximal end 23 of the bristles 22 as well as adjacent portions of the retention element 52 in forming the merged proximal end head portion 26 as a completely sealed unitary element. The laser welding can accordingly be operated at some pre-specified performance characteristics (e.g., laser beam wavelength, resultant temperature of the heated materials, pulsation frequency or duration of continuous operation, beam diameter, speed at which the beam is moved across the proximal end 23, etc.) to melt the corresponding materials to a predictable depth and/or with a predictable depth profile(s) across the width (lateral/radial direction) of each of the tuft assemblies 20.

Figure 4A:
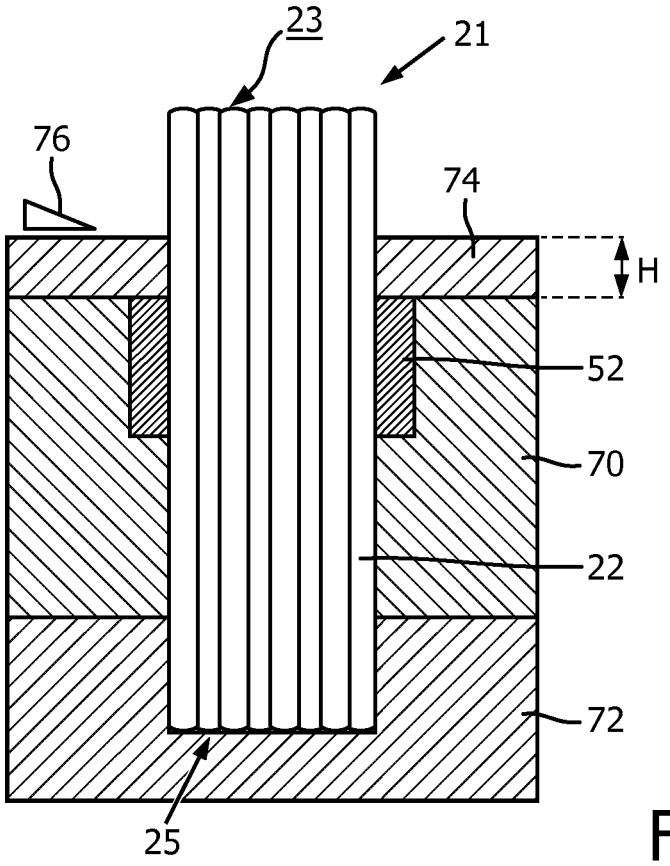
FIGS. 4A and 4B are cross-sectional views of a bristle tuft before and after a proximal end of the bristle tuft is trimmed.
Figure 4B:
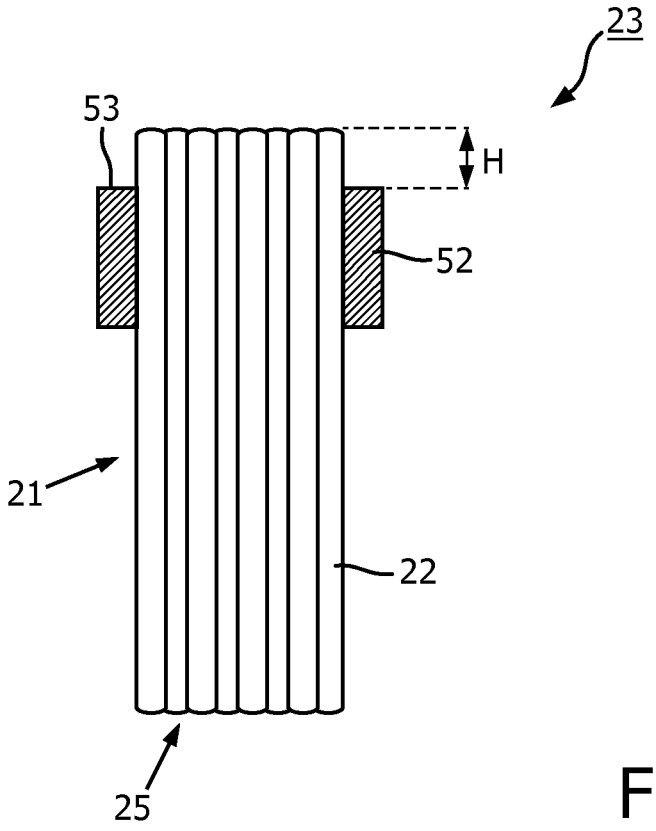

To assist in satisfactorily predictable creation of the merged proximal end head portion 26, the proximal end 23 of the bristle tufts 21 may be trimmed to a predetermined length before laser welding commences. For example, as illustrated in FIG. 4A, the retention element(s) 52 can be placed in a mold 70 during tufting, such that the free end 25 of the bristle tuft is set by a base plate 72. For example, the mold 70 and base plate 72 can be used to set the length and/or contour of the free end 25 of the bristle tuft 21 (which forms the brushing surface of the brush head when completed). A cutting plate 74 having a height H can be placed on the mold 70 at the proximal end 23 of the tuft 21. A knife or cutting implement 76 can be used to trim the length of the bristle tuft 21 by removing the excess portion of the bristle tuft 21 protruding above the plate 76. In this way, as shown in FIG. 4B, the length of bristle tuft extending out from the proximal side 53 of the retention element 52 will approximately equal the height H of plate 74 when the plate 74 is removed. As a result, this preset length of the bristle tuft 21 can be consumed in a predictable manner during laser welding to completely close and seal the proximal end 23 of the tuft assemblies.

Laser welding operations may be configured with respect to one or more weld zones. The weld zones may include a first weld zone adjacent the proximal side 53 of the retention element 52, in which only material from the retention element 52 is melted and reformed, i.e., without integrating any of the bristle strands 22 therein. A second zone may be formed laterally or radially inward of the first zone, in which both a portion of the retention element 52 and the bristle strands 22 are melted and integrated together. A third zone may be formed where only the bristles 22 are melted and integrated together, i.e., without integrating any material from the retention element 52.

If compatible materials are used, the second zone can advantageously fuse together materials from both the retention elements 52 and the bristles 22 and assist in integrating the first and third zones together as a continuous, unitary, sealed structure, e.g., the merged proximal end head portion 26. Any of the weld zones discussed above may be formed to preselected dimensions (e.g., lateral distance and/or longitudinal depth) and/or with some preselected dimensional profile(s) in the corresponding zone, e.g., a gradient laterally/radially across the tuft assembly 20 and/or across any of the zones. The third zone (including just the material from the bristles 22) is expected in many embodiments to be the largest zone, depending on the cross-sectional size of the tufts 21 and the thickness of the retention elements 52.

The selected welding energy or energies, the area/volumes to which the energy/energies are directed, the duration the energy/energies are applied, and other parameters may be varied across the tuft 21 or the tuft carrier 50 and/or across a particular tuft of a particular retention element 52 of the tuft carrier 50. As to any carrier, the parameters of the welding may be configured so as to provide strong, complete, sealed and otherwise desired welds for each tuft-carrier element. For example, particular welding parameters may be adjusted to respond to one or more of various factors, such as: (a) desired shape/dimensions of a weld to set a tuft retention force enabled by the weld and other structural and performance goals relating to the weld; (b) a tuft's shape, dimensions, size, etc.; (c) a tuft carrier or retention element shape, dimensions, size, etc.; (d) alignment/orientation of a tuft with respect to its retention element (e.g., the distance(s), such as the height H, that filaments protrude from the proximal end of the retention element); (e) the alignment/orientation of the tuft carrier or retention element to the platen, e.g., to set performance characteristics of the tufts after final assembly of the brush head; (f) filament(s) shape, structure(s), type, materials, etc.; and/or (g) the carrier/retention element's shape, structure(s), type, materials, etc. The welding configuration may be optimized, e.g., to arrive at desired and proper welds in a minimum or otherwise desired amount of time, or energy (e.g., to minimize or prevent burning or other activity that might change the nature of the weld or any material).

One or more selected welds may be performed by introducing an auxiliary material to selected area of the welding. As an example, an auxiliary material may be introduced at the proximal end of selected or all filaments so that, with welding, a weld is provided that combines the bristles 22 with the auxiliary material and the retention element 52 in locations sufficiently proximate to the retention element 52. The introduction of the selected material may be accomplished by applying the auxiliary material, e.g., as a thread, powder, liquid, etc. to the welding area in a selected mass or volume during welding. The auxiliary material may be the same or similar material as the bristle strands 22, or the retention element 52, some combination of these, or neither of these.

Figure 5:
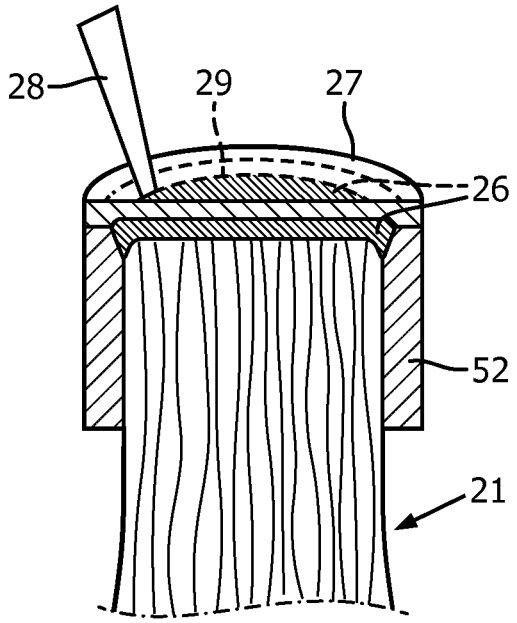
FIG. 5 is a perspective schematic representation of a welded tuft assembly having a cap and of a laser welding process using a transparent component.

For example, as shown in FIG. 5, in one embodiment, one or more plates, caps, coverings, coatings, or other solid volumes comprising a defined amount of an auxiliary material may be applied on, over, or adjacent the selected area(s) for welding. For example, in the case of a plate, its selected area may provide for it to extend beyond the tuft perimeter (e.g., laterally or radially) so as to cover the merged proximal end head portion 26. In this way, after welding, the plate forms a cap 27, as shown in FIG. 5, which covers all, or substantially all, of the merged proximal end head portion 26 of the retention element 52 and the tuft 21 after welding. By this or other manner of introducing auxiliary material across the intended welding area, for example, the seal provided by the welding may be enhanced, e.g., so as to impede or prevent incursion of other materials between the bristles 22 and/or the retention element 52 during subsequent overmolding or other assembly processes.

In one embodiment, the laser welding process is performed using a plate or material that is transparent to the beam of the laser. In this transmission welding technique, the laser may pass through the plate so as to weld the tuft and retention element and, in so doing, generate thermal energy sufficient to join the plate to the retention element 52 and/or the tuft 21. The plate may be placed over the merged proximal end head portion 26 with clamping pressure applied. For example, referring again to FIG. 5, the cap 27 may be made from a material that is transparent to a beam 28 from a laser device, such that the beam 28 passes through the cap 27 and melts the bristle tuft 21 and/or the retention element 52 together at an outer surface 29 of the merged proximal end head portion 26. The heat generated at the outer surface 29 can be sufficient to also bond the cap 27 to the bristle tuft 21 and/or the retention element 52, thereby sealing and/or forming a part of the merged proximal end head portion 26.

Figure 6:
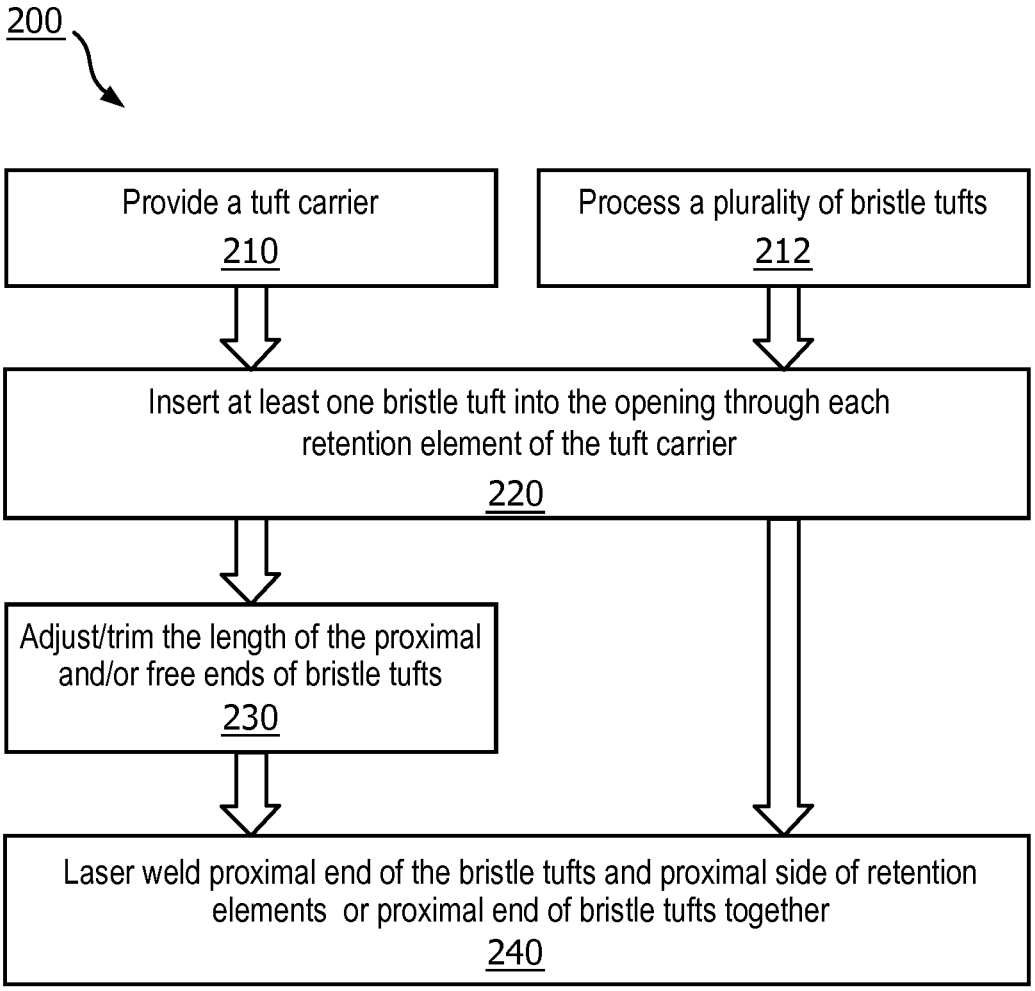
FIG. 6 is a flowchart of a method for manufacturing a brush head assembly with bristle tufts retained in a retention element in accordance with an embodiment.

Referring to FIG. 6, in one embodiment, is a method 200 for manufacturing welded tuft assemblies 20 according to the embodiments and implementations described or otherwise envisioned herein. In step 210 of the method 200, a tuft carrier 50 comprising one or more retention elements 52 is provided. At step 212 of the method, a plurality of bristle tufts 21 are provided, each of which comprises a plurality of bristle strands 22.

At step 220 of the method 200, at least one of the bristle tufts is inserted into an opening 51 of each of the retention elements of the tuft carrier. At optional step 230, the length, contouring, or configuration of a proximal end 23 or a free end 25 of the bristle tufts may be trimmed or otherwise adjusted (e.g., as discussed with respect to FIGS. 4A-4B).

At step 240, a laser is utilized to weld the proximal end 23 of the bristle tuft 21, or the proximal end of the bristle tuft and at least a portion of the proximal side 53 of the retention element 52 together. When cooled or otherwise solidified, the laser welding creates a merged proximal end head portion 26. Step 240 may include adding an auxiliary material (e.g., the cap 27) to assist in creating or sealing the weld.

After the proximal end head portion of the welded tuft assembly has been formed and allowed to cool, the welded tuft assembly can be further processed, either immediately thereafter or at another place and time. For example, in one embodiment, the welded tuft assemblies are positioned relative to a platen 42 portion of the neck 40 of a brush head and overmolded, together with the neck, by a matrix 30 to form a completed brush head 10.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A method for manufacturing a welded tuft assembly for a brush head, comprising:

inserting at least one bristle tuft into an opening in a retention element; and laser welding a proximal end of the bristle tuft that extends past the retention element with a proximal side of the retention element to at least partially melt the bristle tuft and at least a portion of the proximal side of the retention element together to create a merged proximal end head portion, wherein after a formation of the proximal end head portion, the proximal end of the bristle tuft does not extend past the retention element, wherein the proximal end head portion holds the welded tuft assembly together by overlapping the portion of the proximal side of the retention element with the proximal end of the bristle tuft.

2. The method of claim 1, wherein a tuft carrier contains a plurality of retention elements.

3. The method of claim 2, wherein the tuft carrier comprises a plurality of webbing links interconnecting the plurality of retention elements together.

4. The method of claim 3, wherein the webbing links arrange the retention elements and bristle tufts contained therein in a general pattern that defines a final layout for the brush head when fully assembled.

5. The method of claim 2, wherein the tuft carrier comprises a carrier plate that includes the plurality of retention elements.

6. The method of claim 2, wherein each of the retention elements and the bristle tufts are made of the same material or a similar material having a same or similar melting temperature.

7. The method of claim 2 wherein the retention elements and the bristle tufts are made of materials having a different melting temperature.

8. The method of claim 1, further comprising adjusting a length, shape, or contouring of the bristle tuft at the proximal end, a free end opposite the proximal end, or both, before the laser welding.

9. The method of claim 1, further comprising positioning one or more of the welded tuft assemblies with respect to a neck of the brush head and overmolding a matrix to connect the neck and at least a portion the welded tuft assembly together.

10. The method of claim 1, wherein an operation of the laser welding is configured to form a weld zone.

11. The method of claim 10, wherein the weld zone is adjacent to a proximal side of the retention element, wherein material from the retention element is melted and reformed without integrating the bristle strands.

12. The method of claim 1, wherein the weld zone is formed laterally or radially inward, wherein both a portion of the retention element and the bristle strands are melted and integrated together.

13. The method of claim 10, wherein the weld zone is formed where only the bristles are melted and integrated together without integrating any material from the retention element.

14. The method of claim 10, wherein the weld zone is formed to preselected dimensions relating to distance or depth.

15. The method of claim 1, wherein the laser welding is performed using a plate or material that is transparent to the beam of the laser.

16. The method of claim 1, wherein one or more parameters of the laser welding is adjusted to respond to:

a shape, dimension, or size of the bristle tuft, the retention element, or a weld;

an alignment or orientation of the bristle tuft with respect to its corresponding retention element; and an alignment or orientation of the retention element to a platen.

* * * * *